US009893418B2

(12) United States Patent
Oh

(10) Patent No.: US 9,893,418 B2
(45) Date of Patent: Feb. 13, 2018

(54) ANTENNA AND MOBILE DEVICE THEREFOR

(75) Inventor: Sea Won Oh, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 192 days.

(21) Appl. No.: 14/236,784

(22) PCT Filed: Aug. 1, 2012

(86) PCT No.: PCT/KR2012/006143

§ 371 (c)(1),
(2), (4) Date: Mar. 19, 2014

(87) PCT Pub. No.: WO2013/019074

PCT Pub. Date: Feb. 7, 2013

(65) Prior Publication Data

US 2014/0191923 A1 Jul. 10, 2014

(30) Foreign Application Priority Data

Aug. 2, 2011 (KR) ..... 10-2011-0077066

(51) Int. Cl.

| | |
|---|---|
| ***H01Q 1/36*** | (2006.01) |
| ***H01Q 1/10*** | (2006.01) |
| ***H01Q 1/24*** | (2006.01) |
| ***H01Q 9/42*** | (2006.01) |
| ***H01Q 5/20*** | (2015.01) |

(52) U.S. Cl.

CPC ..... *H01Q 1/36* (2013.01); *H01Q 1/10* (2013.01); *H01Q 1/243* (2013.01); *H01Q 5/20* (2015.01); *H01Q 9/42* (2013.01)

(58) Field of Classification Search

CPC ..... H01Q 9/42; H01Q 1/36; H01Q 1/243

USPC ..... 343/848, 895, 702, 797, 801, 818, 846

See application file for complete search history.

(56) References Cited

U.S. PATENT DOCUMENTS

| | | | | |
|---|---|---|---|---|
| 5,087,920 | A | 2/1992 | Tsurumaru et al. | 343/700 |
| 5,309,164 | A | 5/1994 | Dienes et al. | 343/700 |
| 6,067,053 | A * | 5/2000 | Runyon | H01Q 1/246 343/700 MS |
| 6,501,438 | B2 * | 12/2002 | Nevermann | H01Q 1/243 343/895 |
| 6,628,241 | B1 * | 9/2003 | Fukushima | H01Q 1/242 343/702 |

(Continued)

FOREIGN PATENT DOCUMENTS

| | | |
|---|---|---|
| JP | 2001-111336 | 4/2001 |
| WO | WO 2004/070878 | 8/2004 |
| WO | WO 2010/068178 | 6/2010 |

OTHER PUBLICATIONS

International Search Report issued in Application No. PCT/KR2012/006143 dated Jan. 29, 2013.

(Continued)

*Primary Examiner* — Dameon E Levi
*Assistant Examiner* — Ab Salam Alkassim, Jr.
(74) *Attorney, Agent, or Firm* — KED & Associates, LLP

(57) ABSTRACT

Disclosed are an antenna and a mobile device having the same. The antenna includes a plurality of radiators having a pillar shape; a connecting member for connecting the radiators with each other in series; and a ground member for grounding the radiators connected with each other through the connecting member.

18 Claims, 2 Drawing Sheets

(56) References Cited

U.S. PATENT DOCUMENTS

| | | | | |
|---|---|---|---|---|
| 6,992,633 | B2 * | 1/2006 | Kim | H01Q 1/243 343/700 MS |
| 7,324,063 | B2 * | 1/2008 | Bae | H01Q 11/08 343/787 |
| 7,926,165 | B2 * | 4/2011 | Hong | H01Q 1/2283 29/600 |
| 8,237,618 | B2 * | 8/2012 | Wu | H01Q 19/30 343/815 |
| 8,253,646 | B2 * | 8/2012 | Nakatani | H01Q 7/00 343/700 MS |
| 8,842,054 | B2 * | 9/2014 | Zhang | H01Q 11/04 235/487 |
| 9,209,521 | B2 * | 12/2015 | Hung | H01Q 1/38 |
| 2004/0119653 | A1 * | 6/2004 | Asakura | H01Q 1/22 343/702 |
| 2004/0257283 | A1 * | 12/2004 | Asano | H01Q 1/243 343/702 |
| 2005/0248489 | A1 * | 11/2005 | Kim | H01Q 1/243 343/702 |
| 2006/0290589 | A1 * | 12/2006 | Corley | H01Q 1/38 343/895 |
| 2011/0133991 | A1 * | 6/2011 | Lee | H01Q 9/0485 343/700 MS |
| 2011/0241969 | A1 | 10/2011 | Zhang et al. | |
| 2012/0146869 | A1 * | 6/2012 | Holland | H01P 5/10 343/795 |

OTHER PUBLICATIONS

Korean Office Action dated Mar. 24, 2017 issued in Application No. 10-2011-0077066.

* cited by examiner

[Fig. 1]
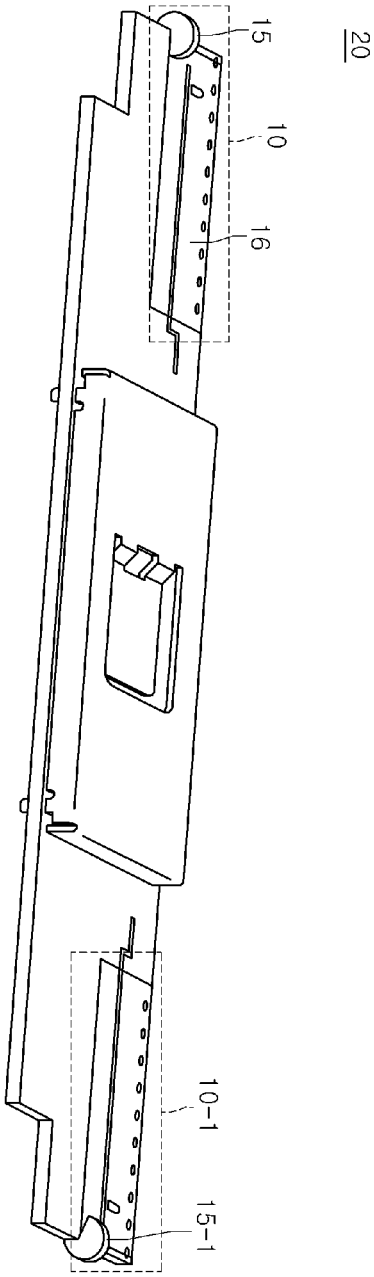

[Fig. 2]
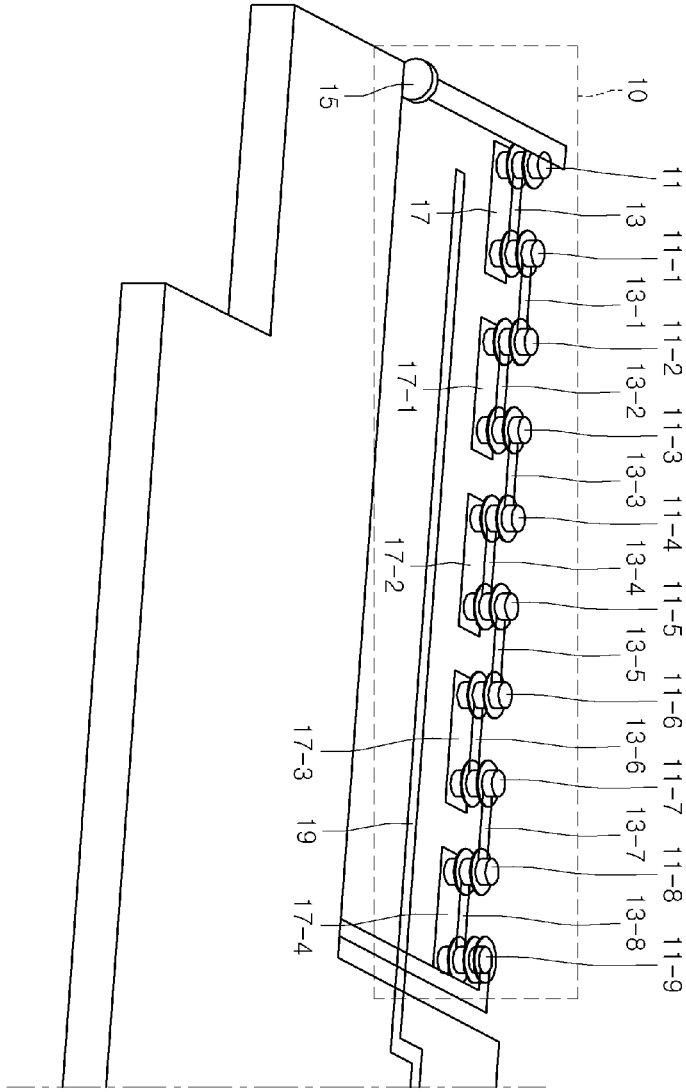

ANTENNA AND MOBILE DEVICE THEREFOR

CROSS-REFERENCE TO RELATED PATENT APPLICATIONS

This application is a U.S. National Stage Application under 35 U.S.C. § 371 of PCT Application No. PCT/KR2012/006143, filed Aug. 1, 2012, which claims priority to Korean Patent Application No. 10-2011-0077066, filed Aug. 2, 2011.

TECHNICAL FIELD

The embodiment relates to an antenna and a mobile device equipped with the antenna, and more particularly, to an antenna which is operated as a loop antenna by connecting a plurality of radiators with each other and a mobile device having the same.

BACKGROUND ART

Recently, an antenna installed in a mobile communication device is manufactured while focusing on a small size and multi-functions. Although the size of a portable terminal has become small-sized, the portable terminal is requested to support various services such as reproduction of video and audio files or application execution. Thus, the antenna for the portable terminal is also requested to have various functions with a small size.

A sub-antenna installed in a portable mobile terminal includes a metal plate antenna having a PIFA (Planar Inverted-F Antenna) structure and a ceramic chip type antenna. Although the performance of the metal plate antenna is lower than that of an external antenna, the metal plate antenna has a merit in that the metal plate antenna can be built in the mobile terminal. However, it is difficult to ensure an installation space for the metal plate antenna due to the large size of the metal plate antenna. Since the design of the metal plate antenna must be changed according to the type of portable devices, there is a problem of increasing the manufacturing cost of the metal plate antenna.

Meanwhile, although the ceramic chip type antenna is small in size, the antenna tuning of the ceramic chip type antenna is difficult. In addition, the ceramic chip type antenna is sensitive to external factors due to its narrow bandwidth. Further, the performance of the ceramic chip type antenna is degraded, so it is difficult to fabricate an antenna, which is easily embedded, has a large bandwidth and an excellent performance.

DISCLOSURE OF INVENTION

Technical Problem

The embodiment can provide an antenna which can be easily embedded in a portable device and has a large bandwidth.

Solution to Problem

An antenna according to the embodiment includes a plurality of radiators having a pillar shape; a connecting member for connecting the radiators with each other in series; and a ground member for grounding the radiators connected with each other through the connecting member.

Advantageous Effects of Invention

The antenna according to the embodiment has a simple structure, can be easily mounted in a small portable device, and has a wide bandwidth.

BRIEF DESCRIPTION OF DRAWINGS

FIG. 1 is a view of a module including an antenna according to an embodiment; and FIG. 2 is a view showing an internal structure of the antenna according to the embodiment.

MODE FOR THE INVENTION

In the description of the embodiments, it will be understood that, when a layer (or film), a region, a pattern, or a structure is referred to as being "on/over" or "under" another substrate, another layer (or film), another region, another pad, or another pattern, it can be "directly" or over the other substrate, layer (or film), region, pad, or pattern, or one or more intervening layers may also be present. Such a position of the layer has been described with reference to the drawings.

Since the thickness and size of each layer shown in the drawings may be modified for the purpose of convenience or clarity of description, the size of elements does not utterly reflect an actual size.

FIG. 1 is a view of a module including an antenna according to an embodiment. Referring to FIG. 1, the antennas 10 and 10-1 according to the embodiment are mounted at both sides of a module 20 and are covered with circuit substrates 16. Further, the antenna 10 and 10-1 may include ground members 15 and 15-1 for grounding the antennas 10 and 10-1, respectively. The ground members 15 and 15-1, as shown in FIG. 1, may be exposed out of the circuit substrate 16, or may be covered with the circuit substrate 16.

Meanwhile, the mobile device according to the embodiment may be applied to predetermined devices, such as a portable telephone equipped with the antenna of FIGS. 1 and 2, a smart phone, and a game player, which are portable and equipped with a wireless communication module.

The shape of the module, the installation place of the antenna, and the number of the antennas may not be limited to those illustrated in FIG. 1, and the internal structure of the antenna will be described below.

FIG. 2 is a view showing the internal structure of the antenna according to the embodiment. Referring to FIG. 2, the antenna 10 according to the embodiment may include a plurality of radiators 11 and 11-1 to 11-9 having a pillar shape, a connecting member 13 and 13-1 to 13-8 for connecting the plurality of radiators 11 and 11-1 to 11-9 with each other in series, and a ground member 15 for grounding the plurality of radiators 11 and 11-1 to 11-9 connected with each other through the connecting member 13 and 13-1 to 13-8. Further, the antenna 10 may further include a plurality parasitic radiators 17 and 17-1 to 17-4 and a second antenna part 19. As one example, in FIG. 2, a current flows from one radiator 11-9 of the plurality of radiators to another radiator 11.

The plurality of radiators 11 and 11-1 to 11-9 may have a cylindrical shape, respectively. The plurality of radiators 11 and 11-1 to 11-9 may be disposed to be spaced apart from with each other by a predetermined distance and the connecting member 13 and 13-1 to 13-8 may connect the plurality of radiators 11 and 11-1 to 11-9 with each other, such that a current may flow alternatively from an upper end to a lower end of each radiator and vice versa. That is, the current flowing direction may be changed whenever the current flows through the radiator, so that a magnetic field may be formed around the antenna due to the current flowing. The magnetic fields formed by each radiator 11 and 11-1 to 11-9 are superimposed or overlapped with each other, such that one magnetic field can be formed around the antenna. Further, due to the various current changes by the plurality of radiators, the frequency band of the antenna may be expanded. For example, although a resonant frequency may be determined based on the last radiator 11, which is grounded from among the plurality of radiators 11 and 11-1 to 11-9, the frequency band of the antenna may be more expanded by the connection of the plurality of radiators 11 and 11-1 to 11-9.

That is, frequency perturbation effect may be utilized through the plurality of radiators 11 and 11-1 to 11-9.

Meanwhile, the plurality of radiators 11 and 11-1 to 11-9 may have a polygonal pillar shape, such as a triangle pillar shape, a square pillar shape, and a hexagonal pillar shape, as well as the cylindrical pillar shape. The plurality of radiators 11 and 11-1 to 11-9 may be formed as a predetermined pillar shape, such that the various changes of the current flowing through the antenna may be induced.

The connecting member 13 and 13-1 to 13-8 may include a plurality of metal plates for connecting adjacent radiators with each other. A current may flow between the radiators through the connecting member 13 and 13-1 to 13-8. As shown in FIG. 2, a metal plate 13 for connecting two radiators 11 and 11-1 to each other connects low sides of the two radiator pillars to each other, and a metal plate 13-1 for connecting two radiators 11-1 and 11-2 to each other connects upper sides of the two radiator pillars to each other. The subsequent metal plates alternately connect the adjacent radiators to each other in the same manner at different horizontal heights of the adjacent radiators. That is, since the metal plates connect the radiators with each other at different horizontal heights of the radiators, the current flowing may be more varied. Thus, the frequency band may be more expanded.

Meanwhile, although the connecting members 13 and 13-1 to 13-8 connect two adjacent radiators to each other in FIG. 2, the number of radiators connected through one metal plate is not limited thereto and the connection position is not limited thereto.

The ground member 15 may be prepared as a terminal having a predetermined capacitance, such that the usable frequency may be controlled depending on the predetermined capacitance. For example, when an antenna having a usable frequency of 2.4 GHz is fabricated and mounted in a module, the usable frequency of the antenna mounted in the module may vary from the usable frequency of the antenna which is set when the antenna is fabricated. In order to adjust the variation, the ground member 15 is designed to be exposed. Thus, even if the antenna is mounted while being covered with the substrate 16, the capacitance of the ground member 15 may be adjusted. Thus, the variation of the usable frequency may be compensated.

As shown in FIG. 2, the plurality parasitic radiators 17 and 17-1 to 17-4 may be disposed at a lower surface corresponding to an upper surface of the plurality of radiators 11 and 11-1 to 11-9 covered with the circuit substrate 16. The parasitic radiators 17 and 17-1 to 17-4 are not electrically connected to the plurality of radiators 11 and 11-1 to 11-9. Unlike the connecting member, each of the plurality of parasitic radiators connects several radiators 11 and 11-1 to 11-9 to each other at the lower surface of the plurality of radiators 11 and 11-1 to 11-9, and the plurality of parasitic radiators may be spaced apart from each other by a predetermined distance. The parasitic radiators are physically connected to and extends between respective ones of the radiators 11 and 11-1 to 11-9 but are not galvanically connected with radiators 11 and 11-1 to 11-9. Thus, the intensity of the magnetic field generated by each of the plurality of radiators 11 and 11-1 to 11-9 may be maximized. That is, the intensity of the magnetic field generated from the whole area of the antenna may become increased, so that the transmitting and receiving sensitivity of the antenna may be improved.

Meanwhile, the antenna 10 according to the embodiment further includes the second antenna part 19, so that the antenna 10 may be operated as a dual antenna. The second antenna part 19 may be connected to ends of the plurality of parasitic radiators and extended in parallel with the connection direction of the connecting member 13 and 13-1 to 13-8

As described above, according to the embodiment, the installation of the antenna may be easy and the bandwidth is expanded, so that the antenna having the superior performance and the mobile device equipped with the antenna can be provided.

Any reference in this specification to one embodiment, an embodiment, example embodiment, etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An antenna comprising:

a first radiator having a pillar shape;

a second radiator having a pillar shape;

a third radiator having a pillar shape;

a substrate to cover the first to third radiators;

a ground member;

a first connecting member interleaved at a low side of the first radiator and interleaved at a low side of the second radiator, and connecting the first radiator and the second radiator in series;

a second connecting member interleaved at an upper side of the second radiator and interleaved at a top portion of the third radiator, and connecting the second radiator and the third radiator in series; and a first parasitic radiator disposed on a bottom portion of the first radiator and a bottom portion of the second radiator and extends between the first radiator and the second, wherein the first parasitic radiator is a radiator that is not galvanically connected with the first radiator and the second radiator, wherein one end of the second radiator is disposed to be coupled to the first radiator and an opposite end of the second radiator is disposed to be coupled to the third radiator.

2. The antenna of claim 1, further comprising: a third radiator having a pillar shape; a fourth radiator having a pillar shape; a second connecting member disposed on a top portion of the second radiator and a top portion of the third radiator, and connecting the second radiator and the third radiator in series; a third connecting member disposed on a middle portion of the third radiator and a middle portion of the fourth radiator, and connecting the third radiator and the fourth radiator in series; and a second parasitic radiator disposed on a bottom portion of the third radiator and a bottom portion of the fourth radiator.

3. The antenna of claim 2, further comprising: a fifth radiator having a pillar shape; a sixth radiator having a pillar shape; a fourth connecting member disposed on a top portion of the fourth radiator and a top portion of the fifth radiator, and connecting the fourth radiator and the fifth radiator in series; a fifth connecting member disposed on a middle portion of the fifth radiator and a middle portion of the sixth radiator, and connecting the fifth radiator and the sixth radiator in series; and a third parasitic radiator disposed on a bottom portion of the fifth radiator and a bottom portion of the sixth radiator.

4. The antenna of claim 3, further comprising: a seventh radiator having a pillar shape; a eighth radiator having a pillar shape; a sixth connecting member disposed on a top portion of the sixth radiator and a top portion of the seventh radiator, and connecting the sixth radiator and the seventh radiator in a seventh connecting member disposed on a middle portion of the seventh radiator and a middle portion of the eighth radiator, and connecting the seventh radiator and the eighth radiator in series; and a fourth parasitic radiator disposed on a bottom portion of the seventh radiator and a bottom portion of the eighth radiator.

5. The antenna of claim 4, further comprising: a ninth radiator having a pillar shape; a tenth radiator having a pillar shape; a eighth connecting member disposed on a top portion of the eighth radiator and a top portion of the ninth radiator, and connecting the eighth radiator and the ninth radiator in series; a ninth connecting member disposed on a middle portion of the ninth radiator and a middle portion of the tenth radiator, and connecting the ninth radiator and the tenth radiator in series; and a fifth parasitic radiator disposed on a bottom portion of the ninth radiator and a bottom portion of the tenth radiator.

6. The antenna of claim 5, further comprising a second antenna member extending in parallel with a connecting direction of the parasitic radiators, wherein the antenna is operated in a dual frequency band by the second antenna member.

7. The antenna of claim 5, further comprising a tenth connecting member disposed on a top portion of the tenth radiator.

8. The antenna of claim 7, wherein the tenth connecting member receives power from a power source, wherein a current by the power source flows from the tenth radiator to the first radiator.

9. The antenna of claim 6, wherein the second antenna member is connected to ends of the parasitic radiators.

10. A mobile device comprising:

an antenna; and a substrate to cover the antenna, wherein the antenna comprises:

a first radiator having a pillar shape;

a second radiator having a pillar shape;

a third radiator having a pillar shape;

a ground member;

a first connecting member interleaved at a low side of the first radiator and interleaved at a low side of the second radiator, and connecting the first radiator and the second radiator in series;

a second connecting member interleaved at an upper side of the second radiator and interleaved at a top portion of the third radiator, and connecting the second radiator and the third radiator in series; and a first parasitic radiator disposed on a bottom portion of the first radiator and a bottom portion of the second radiator and extends between the first radiator and the second, wherein the first parasitic radiator is a radiator that is not galvanically connected with the first radiator and the second radiator, wherein one end of the second radiator is disposed to be coupled to the first radiator and an opposite end of the second radiator is disposed to be coupled to the third radiator.

11. The mobile device of claim 10, further comprising: a third radiator having a pillar shape; a fourth radiator having a pillar shape; a second connecting member disposed on a top portion of the second radiator and a top portion of the third radiator, and connecting the second radiator and the third radiator in series; a third connecting member disposed on a middle portion of the third radiator and a middle portion of the fourth radiator, and connecting the third radiator and the fourth radiator in series; and a second parasitic radiator disposed on a bottom portion of the third radiator and a bottom portion of the fourth radiator.

12. The mobile device of claim 11, further comprising: a fifth radiator having a pillar shape; a sixth radiator having a pillar shape; a fourth connecting member disposed on a top portion of the fourth radiator and a top portion of the fifth radiator, and connecting the fourth radiator and the fifth radiator in series; a fifth connecting member disposed on a middle portion of the fifth radiator and a a third parasitic radiator disposed on a bottom portion of the fifth radiator and a bottom portion of the sixth radiator.

13. The mobile device of claim 12, further comprising: a seventh radiator having a pillar shape; a eighth radiator having a pillar shape; a sixth connecting member disposed on a top portion of the sixth radiator and a top portion of the seventh radiator, and connecting the sixth radiator and the seventh radiator in series; a seventh connecting member disposed on a middle portion of the seventh radiator and a middle portion of the eighth radiator, and connecting the seventh radiator and the eighth radiator in series; and a fourth parasitic radiator disposed on a bottom portion of the seventh radiator and a bottom portion of the eighth radiator.

14. The mobile device of claim 13, further comprising: a ninth radiator having a pillar shape; a tenth radiator having a pillar shape; a eighth connecting member disposed on a top portion of the eighth radiator and a top portion of the ninth radiator, and connecting the eighth radiator and the ninth radiator in series; a ninth connecting member disposed on a middle portion of the ninth radiator and a middle portion of the tenth radiator, and connecting the ninth radiator and the tenth radiator in series; and a fifth parasitic radiator disposed on a bottom portion of the ninth radiator and a bottom portion of the tenth radiator.

15. The mobile device of claim 14, further comprising a second antenna member extending in parallel with a connecting direction of the parasitic radiators, wherein the mobile device is operated in a dual frequency band by the second antenna member.

16. The mobile device of claim 14, further comprising a tenth connecting member disposed on a top portion of the tenth radiator.

17. The mobile device of claim 16, wherein the tenth wherein a current by the power source flows from the tenth radiator to the first radiator.

18. The mobile device of claim 15, wherein the second antenna member is connected to an end of the fifth parasitic radiator.

* * * * *